US005374173A

United States Patent [19]

Maruyama et al.

[11] Patent Number: 5,374,173

[45] Date of Patent: Dec. 20, 1994

[54] FLUID ROTATING APPARATUS WITH SEALING ARRANGEMENT

[75] Inventors: Teruo Maruyama, Hirakata; Akira Takara, Moriguchi; Yoshikazu Abe, Neyagawa, all of Japan

[73] Assignee: Matsushita Electric Industrial Co., Ltd., Osaka, Japan

[21] Appl. No.: 156,723

[22] Filed: Nov. 24, 1993

Related U.S. Application Data

[62] Division of Ser. No. 941,171, Sep. 4, 1992, Pat. No. 5,295,798.

[51] Int. Cl.[5] ..... F01C 1/16

[52] U.S. Cl. ..... 418/201.1; 418/143; 418/144

[58] Field of Search ..... 418/143, 144, 201.1, 418/202, 203

[56] References Cited

U.S. PATENT DOCUMENTS

| | | | |
|---|---|---|---|
| Re. 17,689 | 6/1930 | Hibbard . | |
| 2,640,428 | 6/1953 | Houghton . | |
| 3,811,805 | 5/1974 | Moody, Jr. et al. | 418/203 |
| 4,152,092 | 5/1979 | Swearingen | 415/53 R |
| 4,758,132 | 7/1988 | Hartwig | 418/201 |
| 4,797,068 | 1/1989 | Hayakawa et al. | 418/201 |
| 4,808,077 | 2/1989 | Kan et al. | 417/2 |
| 4,850,806 | 7/1989 | Morgan et al. | 417/53 |
| 5,062,771 | 11/1992 | Satou et al. | 417/201 |
| 5,120,208 | 6/1992 | Toyoshima et al. | 418/201.3 |
| 5,197,861 | 3/1993 | Maruyama et al. | 417/42 |

FOREIGN PATENT DOCUMENTS

| | | |
|---|---|---|
| 0230868 | 8/1987 | European Pat. Off. . |
| 60-259791 | 12/1985 | Japan . |
| 809445 | 2/1959 | United Kingdom . |
| 2123089 | 1/1984 | United Kingdom . |

OTHER PUBLICATIONS

"A Generalized Performance Computer Program for Oil Flooded Twin-Screw Compressor", Pawan J. Singh and Ghanshyam C., Patel, Ingersoll-Rand Research, Inc. Princeton, N.J., 1984, pp. 544–553.

"Computer Modeling For Performance Analysis of Rotary Screw Compressor": Mitsuru Fujiwara and Katsuhiko Kasuya, Mechanical Engineering Research Laboratory, Hitachi, Ltd., Ibaraki, Japan, 1984, pp. 536–543.

"A New Molecular Pump":, Louis Maurice, Proc. 6th Interl. Vacuum Congr. 1974 Japan, J. Appl. Phnys. Suppl. 2, Pt. 1, 1974.

*Primary Examiner*—Richard A. Bertsch
*Assistant Examiner*—Charles G. Freay
*Attorney, Agent, or Firm*—Wenderoth, Lind & Ponack

[57] ABSTRACT

A fluid rotating apparatus includes a casing having a gas inhaling inlet and a gas discharge outlet, rotors driven in the casing by a driving mechanism and having fluid-transporting grooves which engage each other in synchronous rotation, and bearing portion for supporting the rotors. A communicating path is formed at one of the rotors and the and the casing for communicating a gas discharge-side inner space and a space defined by an inner surface of the casing and the fluid-transporting groove of an outer surface of each rotor with each other. The gas discharge-side inner space is defined by an end surface of the rotor opposite to a gas inhaling-side surface thereof, and a sealing portion which is formed between the rotor and the casing to prevent fluid from flowing into the gas discharge-side inner space.

10 Claims, 14 Drawing Sheets

*Fig. 19* - PRIOR ART
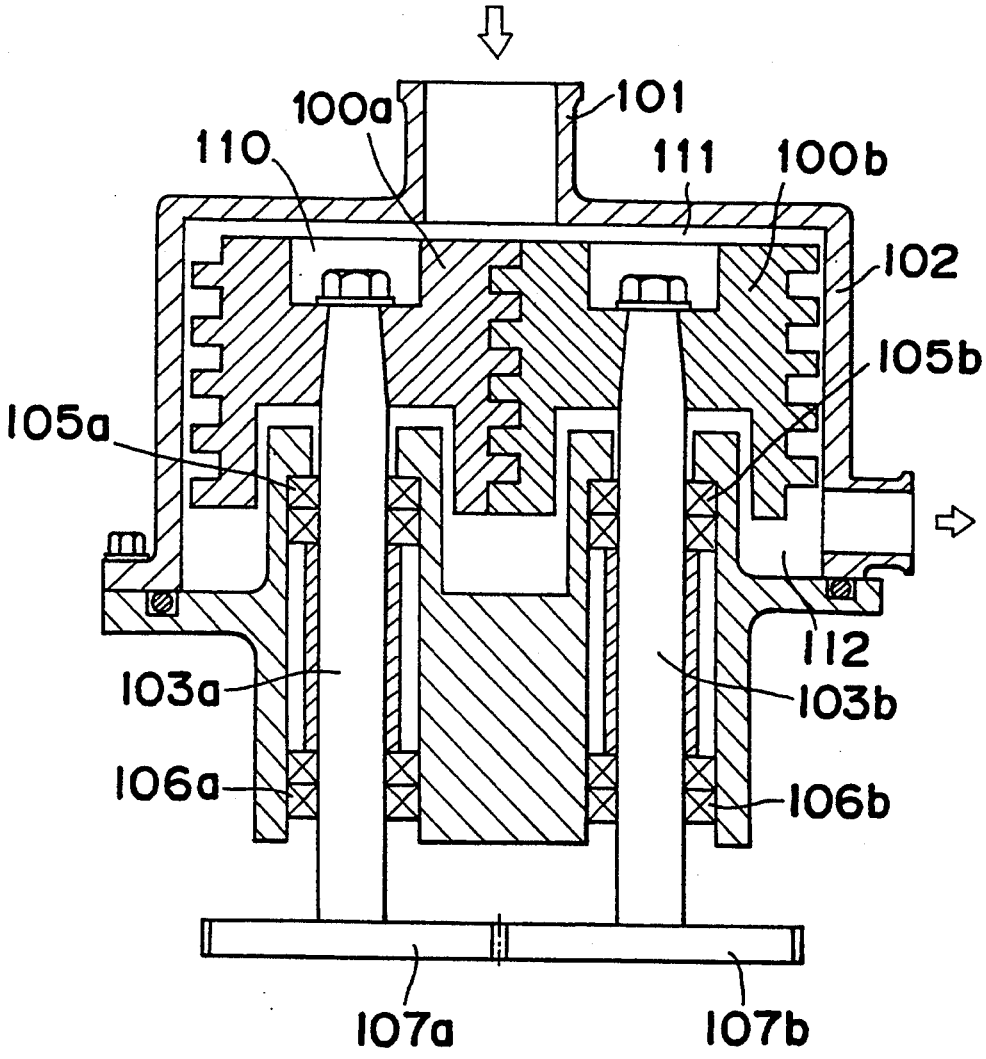

FLUID ROTATING APPARATUS WITH SEALING ARRANGEMENT

This is a divisional application of Ser. No. 07/941,171, filed Sep. 4, 1992, now U.S. Pat. No. 5,295,798.

BACKGROUND OF THE INVENTION

The present invention relates to a fluid rotating apparatus to be used to discharge gas from a chamber such as a vacuum chamber of a semiconductor-manufacturing device.

A vacuum pump is used to provide a vacuum environment in a CVD apparatus, a dry etching apparatus, or a sputtering apparatus used in the manufacturing process of a semiconductor. In recent years, there has been a growing demand for a vacuum pump having an advanced function. For example, the development of a vacuum pump which provides a high ultimate vacuum is needed, because the process of manufacturing semiconductors has become highly integrated and fine-structured. In addition, vacuum chambers are becoming larger and larger as wafers and liquid crystal bases are becoming larger. Under these circumstances, it is necessary to use a large vacuum pump so as to increase a discharge speed of gas.

A screw thread groove type twin rotor vacuum pump which generates little vibration and noise is used in semiconductor-manufacturing process. As shown in FIG. 19, a conventional thread groove type twin rotor vacuum pump comprises two rotors 100*a* and 100*b*, accommodated in a casing 102, which rotate in opposite directions and have concave and convex grooves meshed with but not contacting each other. Gas is inhaled from an inlet 101 and discharged from an outlet (not numbered). The rotors 100*a* and 100*b* are fixed to each of shafts 103*a* and 103*b*. Ball bearings 105*a* and 106*a* support the shaft 103*a*. Ball bearings 105*b* and 106*b* support the shaft 103*b*. Timing gears 107*a* and 107*b* are disposed at the lower ends of the shafts 103*a* and 103*b* to allow the rotors 100*a* and 100*b* to rotate synchronously.

It is necessary to consider the capacity of a load to be applied to a bearing portion in designing the bearing portion for use in the twin rotor vacuum pump. The disadvantage of the conventional twin rotor vacuum pump is that a thrust load is applied to the bearing portion is greater than a radial load because the pressure difference between the upper surface and the lower surface of each rotor perpendicular to the shaft of each of the rotors 100*a* and 100*b*, namely, between a gas inlet side 111 and a gas outlet side 112, is applied to the rotors 100*a* and 100*b* as the thrust load. For example, supposing that the pressure difference between the gas inlet side 111 and the gas outlet side 112 is $\Delta P = 1\ kg/cm^2$ and the diameter of each rotor is 10 cm, a thrust load of $F = 5^2 * 3.14 * 1 = 78.5$ kgf is applied to the bearing portion.

In order to eliminate this disadvantage, lubricating oil accommodated in an oil tank (not shown) is fed to the bearing portion. Thus, the lubricating performance of the pump is maintained under the condition in which a high load is applied to the bearing portion and the pump is continuously operated. But due to the increase in the number of rotations of the rotors or the manufacture of a large pump caused by recent demands for an advanced performance vacuum pump requiring increased gas-discharge performance made in recent years, more load is applied to the bearing portion. Under these circumstances, the development of techniques for securing the long life of the bearing portion is required.

SUMMARY OF THE INVENTION

Accordingly, an object of the present invention is to provide a fluid rotating apparatus capable of greatly reducing a thrust load applied to a bearing so that the bearing has a long life.

In accomplishing this and other objects, according to one aspect of the present invention, there is provided a fluid rotating apparatus comprising:

a casing having a gas inhaling inlet and a gas discharge outlet;

a rotor driven in the casing by a driving means and having a pair of male and female fluid-transporting grooves which engage with each other to rotate synchronously;

a bearing portion for supporting the rotors;

a communicating path, formed at one of the rotor and the casing, for communicating a gas discharge-side inner space with a space defined by an inner surface of the casing and the fluid-transporting groove of an outer surface of each rotor, the gas discharge-side inner space being defined by an end surface of the rotor opposite to a gas inhaling-side surface thereof; and a sealing portion, formed between the rotor and the casing, for preventing fluid from flowing into the gas discharge-side inner space.

BRIEF DESCRIPTION OF THE DRAWINGS

These and other objects and features of the present invention will become clear from the following description taken in conjunction with the preferred embodiments thereof with reference to the accompanying drawings, in which:

FIG. 19 is a sectional view showing a conventional vacuum pump.

DETAILED DESCRIPTION OF THE INVENTION

Figure 1:
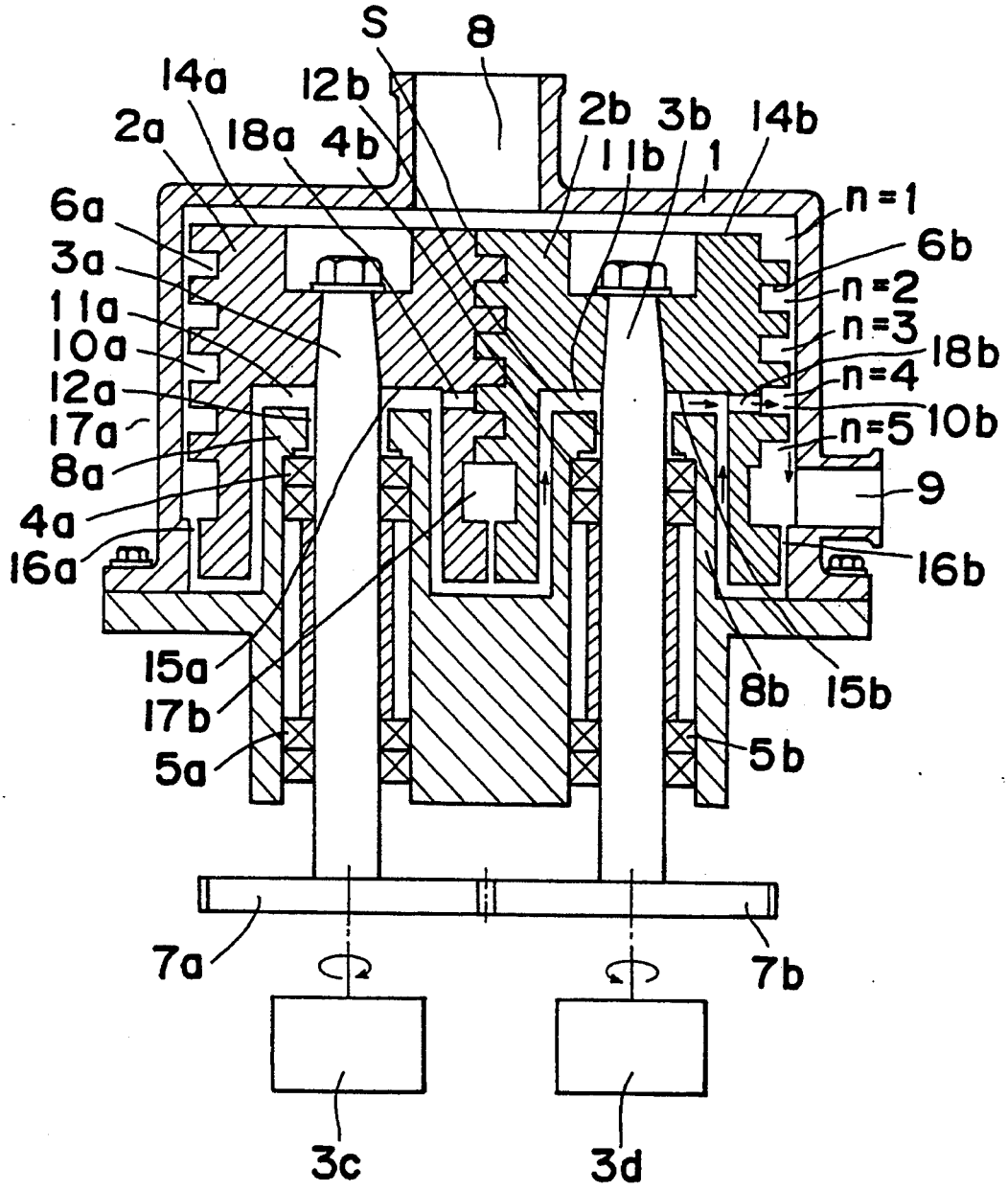
FIG. 1 is a sectional view showing a thread groove type twin rotor vacuum pump according to a first embodiment of the present invention.

Before the description of the present invention proceeds, it is to be noted that like parts are designated by like reference numerals throughout the accompanying drawings.

Figure 2:
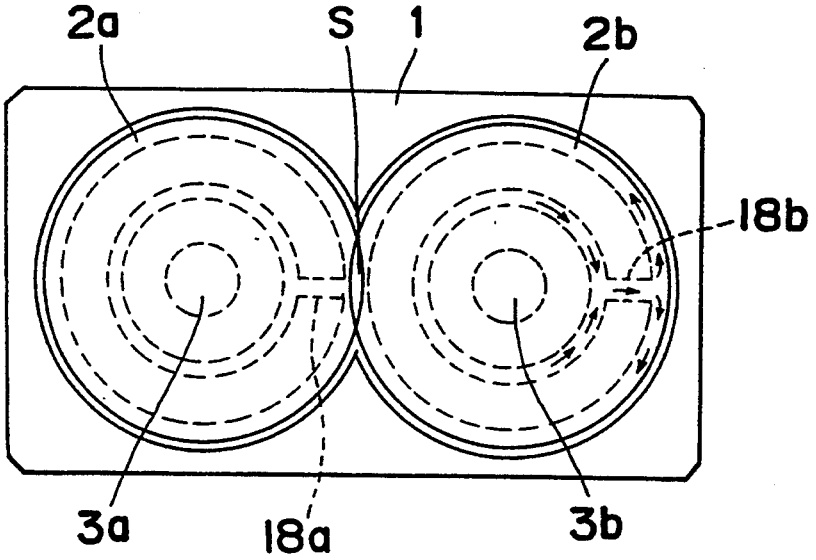
FIG. 2 is a plan view of the pump of FIG. 1.
Figure 3:
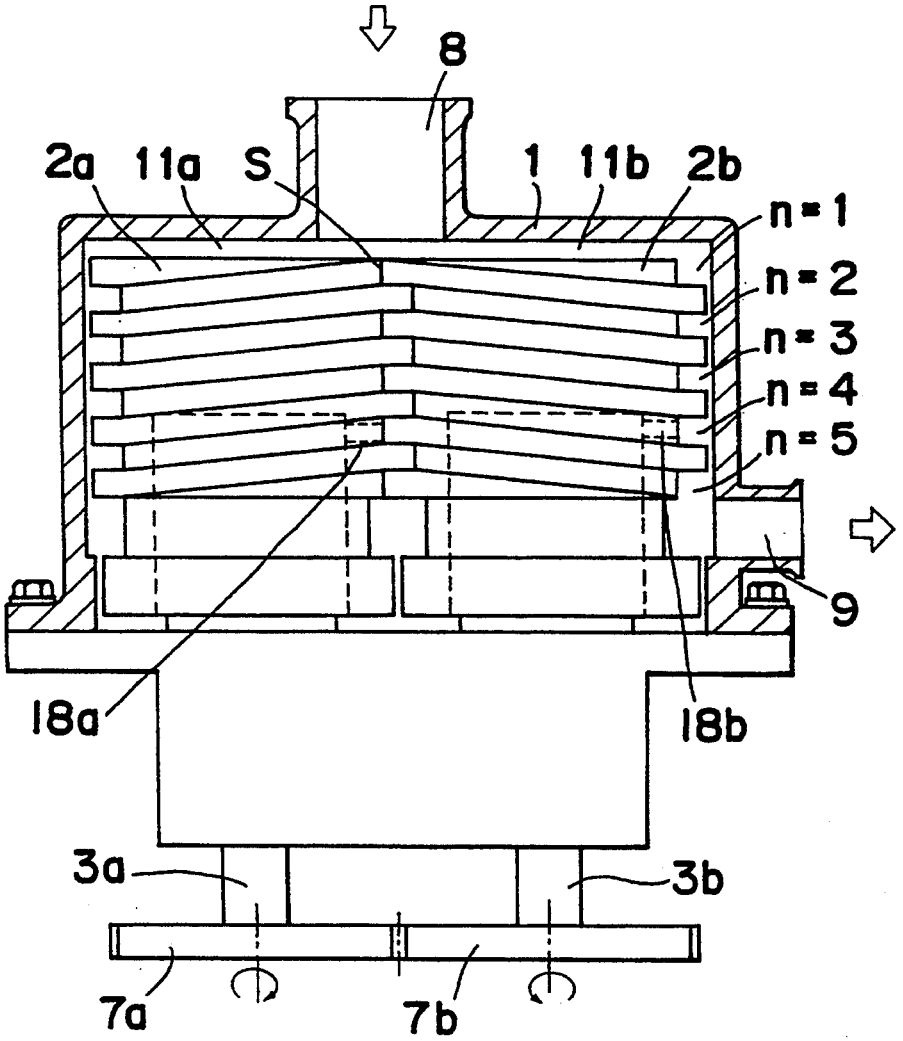
FIG. 3 is a partly sectional view showing the pump of FIG. 1.

Referring to FIGS. 1 through 3 showing the principles of the present invention, the construction of a vacuum pump according to a first embodiment of the present invention is described below.

Two rotors 2*a* and 2*b* are accommodated inside a casing 1 comprising a gas inlet 8 and a gas outlet 9. The shafts 3*a* and 3*b* of the rotors 2*a* and 2*b* are supported by radial bearings 4*a*, 5*a* and 4*b*, 5*b* to be rotated by motors 3*c* and 3*d*, respectively. Thread grooves (fluid transporting grooves) 6*a* and 6*b* are formed on the rotors 2*a* and 2*b*, respectively. Timing gears 7*a* and 7*b* disposed at the lower ends of the shafts 3*a* and 3*b* serve as means for rotating the rotors 2*a* and 2*b* synchronously. Upper radial bearings 4*a* and 4*b* are disposed inside fixed sleeves 8*a* and 8*b* accommodated inside the rotors 2*a* and 2*b*.

The upper surface of each of the rotors 2*a* and 2*b* is denoted as a gas inhaling-side surface 14*a* and 14*b*, respectively, and the surface opposite to each of the gas inhaling-side surface 14*a* and 14*b* is denoted as a gas discharge-side surface 15*a* and 15*b*, respectively. The space between the gas discharge-side surface 15*a* and the fixed sleeve 8*a* and the space between the gas discharge-side surface 15*b* and the fixed sleeve 8*b* are denoted as inner spaces 11*a* and 11*b*, respectively. The rotors 2*a* and 2*b* have communicating paths 18*a* and 18*b* which communicate the inner space 11*a* with a fluid transporting space 10*a* and the inner space 11*b* with a fluid transporting space 10*b*, respectively. The fluid transporting space 10*a* is positioned between the fluid transporting groove 6*a* and the casing 1, and the fluid transporting space 10*b* is positioned between the fluid transporting groove 6*b* and the casing 1. First sealing portions 12*a* and 12*b* are formed in a small space between the shaft 3*a* and the fixed sleeve 8*a* and in a small space between the shaft 3*b* and the fixed sleeve 8*b*, respectively. Second sealing portions 16*a* and 16*b* are formed in a small space between the outer surface of the rotor 2*a* and the casing 1 and in a small space between the outer surface of the rotor 2*b* and the casing 1, respectively.

In the first embodiment, as described above, the twin rotor type vacuum pump has the thread grooves, and the communicating paths 18*a* and 18*b* which communicate the inner space 11*a* with the fluid transporting space 10*a* and the inner space 11*b* with the fluid transporting space 10*b*, respectively, are formed in the rotors 2*a* and 2*b* at an intermediate portion of a plurality of the thread grooves. This construction reduces the influence of pressure on the gas inhaling side of the pump so as to avoid deterioration of the performance thereof.

The reason that the performance of the pump is not deteriorated in the above-described construction is described below with reference to FIGS. 4 through 8.

FIGS. 4 through 8 show the processes (N=0−4) of gas inhalation, gas transporting, and gas discharge of the pump according to the first embodiment. Chain lines in FIGS. 4 through 8 show the back sides of thread grooves 6*a* and 6*b* in FIG. 1. Reference symbols (S) shown in the center and at both sides in FIGS. 1 and 4 through 8 indicate portions in which sealing lines are formed due to the engagement between the rotors 2*a* and 2*b*.

In the twin rotor vacuum pump in which the thread groove is used, the sealing lines (S), the thread grooves 6*a* and 6*b*, and the casing 1 form fluid transporting spaces (n=1−5) for transporting fluid from the gas inhaling side to the gas discharge side. The method to be carried out by the transporting spaces formed in the rotor 2*b* in transporting the fluid is described below.

Figure 4:
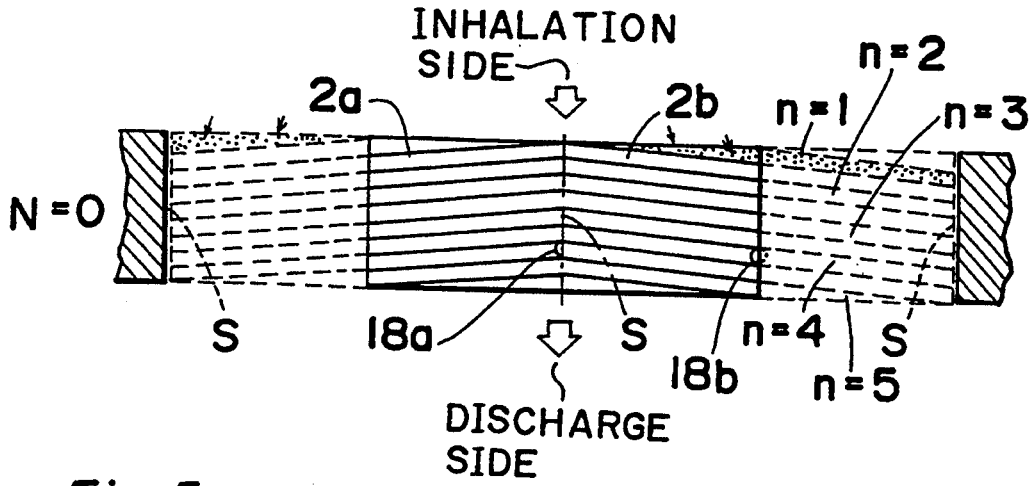
FIGS. 4–8 are views showing the processes of inhaling, transporting, and discharging to be performed in the pump of FIG. 1.

(1) N=0 shows the state immediately after the start of the gas inhaling process as shown in FIG. 4. That is, gas introduced from the gas inhaling side is accommodated in the groove of n=1 as shown by arrows of FIG. 4.

Figure 5:
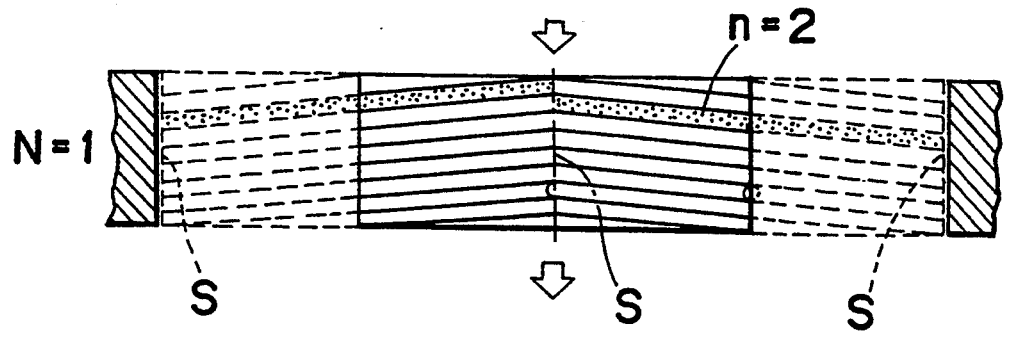
Figure 6:
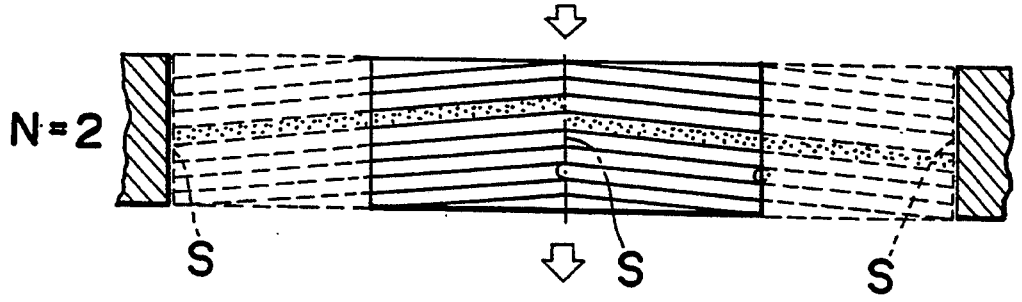

(2) The gas moves from the groove of n=1 to the groove of n=2 during the rotation of N=1 and remains in the space which is intercepted from the gas inhaling side as shown in FIG. 5. The gas moves from the groove of n=2 to the groove of n=3 during the rotation of N=2, and remains enclosed in the space without changing its volume as shown in FIG. 6.

Figure 7:
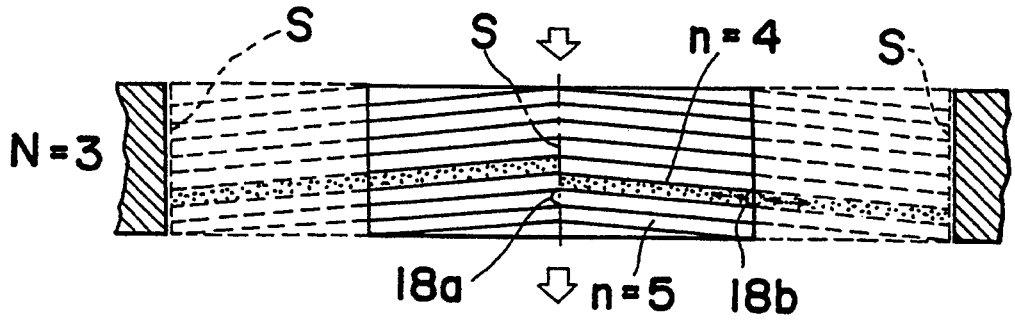

(3) During the rotation of N=3, the gas moves from the groove of n=3 to the groove of n=4 which has an opening of the communicating path 18*b* as shown in FIG. 7. As described previously, the communicating path 18*b* communicates with the inner space 11*b* formed in the rotor 2*b*. The flow direction of the gas passing through the communicating path 18*b* differs in the following two cases. Supposing that the gas pressure of the inner space 11*b* of the rotor 2*b* is $P_R$ and the gas pressure in the groove of n=4 is $P_g$:

[1] when $P_R > P_g$,

In this state, the vacuum pump is communicating with a vacuum chamber maintained in its vacuum state and the vacuum pump is continuously operated. The gas inhaling side is kept at a very low degree of vacuum while gas flows from the first and second sealing portions 12*b* and 16*b*, each communicating with the atmospheric air, to the inner space 11*b*. Then, the gas pressure $P_R$ to become higher than the gas pressure $P_g$ on the suction side. The gas pressure $P_g$ of the groove of n=4 is approximately equal to the gas pressure $P_S$ of the gas inhaling side. Accordingly, the gas in the inner space 11*b* is discharged from the communicating path 18*b* to the fluid transporting space 10*b* due to the pressure difference between $P_R$ and $P_g$. As a result, the gas pressure $P_R$ approaches the gas pressure $P_g$;

[2] when $P_R < P_g$,

This state is generated when the gas condition is changed from the above state [1] to the state in which the gas inhaling side starts communication with the atmospheric air with the vacuum pump being operated. The gas pressure $P_g$ of the groove of n=4 becomes equal to the gas pressure $P_S$ (atmospheric pressure) of the gas inhaling side after the rotation of at least N=3 with the gas inhaling side communicating with the atmospheric air. Since the gas pressure $P_g$ of the inner space 11*b* is already at a very low degree of vacuum in the state of [1], $P_R < P_g$. Accordingly, different from the above state [1], the gas flows from the groove of n=4 to the inner space 11*b*. As a result, the gas pressure $P_R$ approaches the gas pressure $P_g$.

Therefore, in both the above states [1] and [2], $P_R \approx P_g \approx P_S$. Thus, the thrust load to be generated due to the pressure difference between the gas inhaling-side surface 14*b* of the rotor 2 and the gas discharge-side surface 15*b* thereof is greatly reduced.

Figure 8:
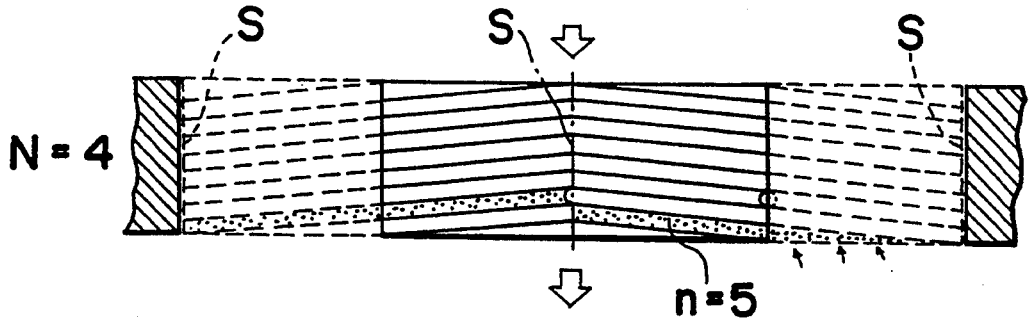
Figure 9:
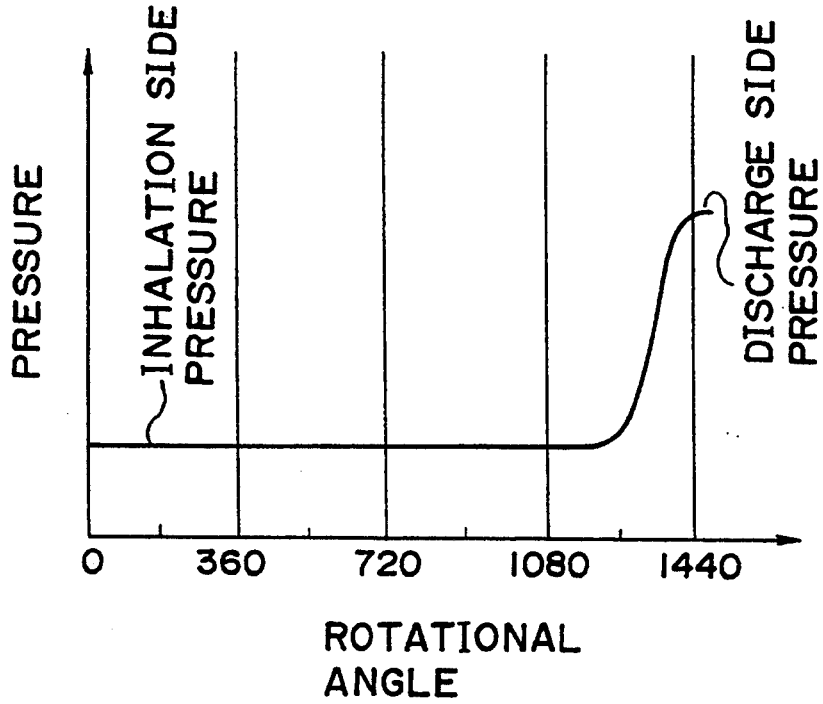
FIG. 9 is a graph showing pressure characteristics with respect to rotational angles according to the first embodiment of the present invention.

(4) The gas which has reached the groove of n=5 during the rotation of N=4 communicates with the atmospheric air of the gas discharge side 9 as shown in FIG. 8. When the gas inhaling side has a low degree of vacuum at this time, the gas in the groove n=5 is also at a low degree of vacuum. As a result, gas flows from the gas discharge side, namely, the gas outlet 9 into the groove of n=5 as shown in FIG. 8. As shown by the graph showing the relationship between rotational angle and pressure characteristic in FIG. 9, the gas in the fluid transporting space 10*b* first communicates with the atmospheric air. Consequently, the gas pressure rises.

If the gas pressure on the gas inhaling side rises, the attainable vacuum pressure of the vacuum pump may be limited. However, the gas which has flowed into the thread groove through the communicating paths 18*a* and 18*b* does not increase the pressure of the gas inhaling side. According to the embodiment, since the type of the vacuum pump and the positions of the communicating paths 18*a* and 18*b* are appropriately selected, the thrust load can be reduced to a great extent with the bad influence on the pump performance reduced. The reason is that the movement of gas between the inner spaces 11*a*, 11*b* and the fluid transporting spaces 10*a*, 10*b* occurs only in the gas-transporting process before and after the rotation of N=3. In other words, the space between the groove of n=4 and the gas inhaling side is sealed by the sealing line (S) and a multistage thread of the thread groove.

Figure 10:
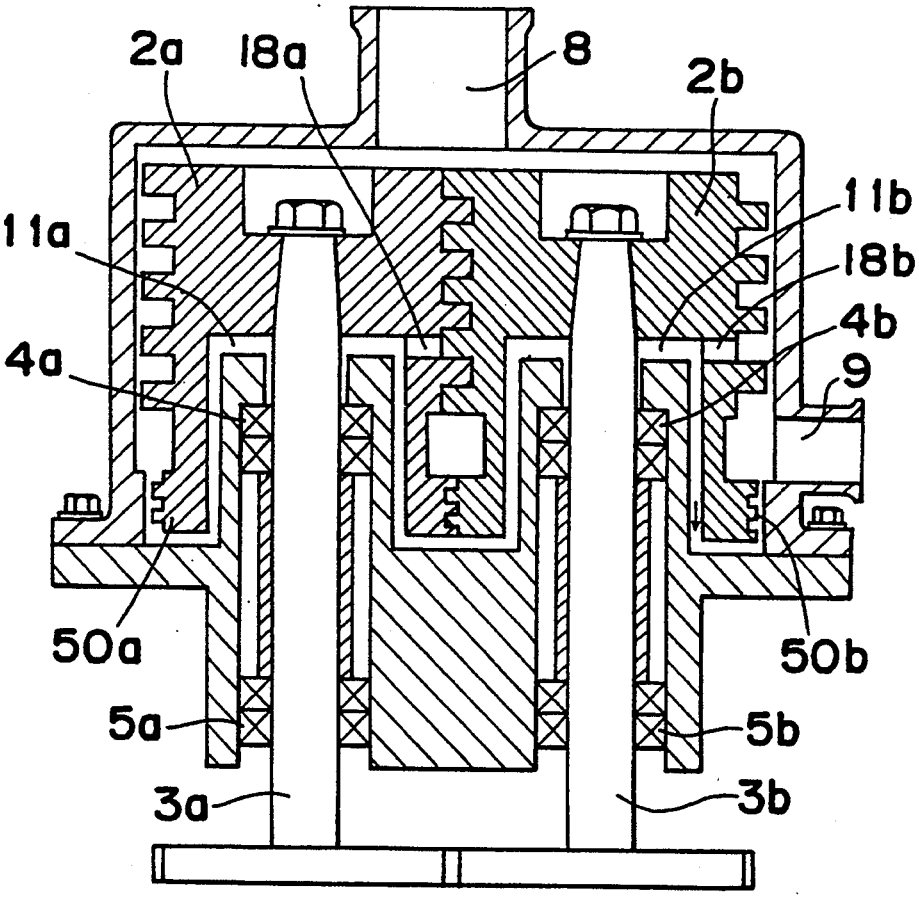
FIG. 10 is a sectional view showing a vacuum pump according to a second embodiment of the present invention.
Figure 11:
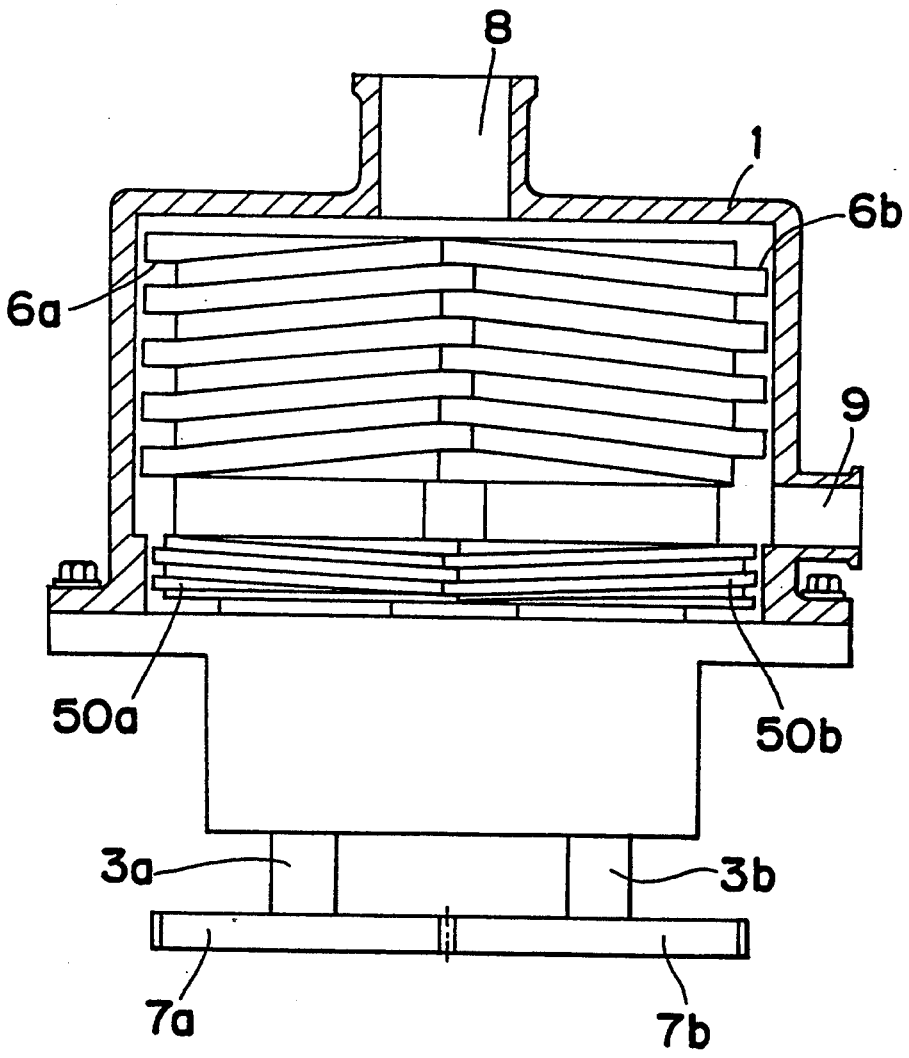
FIG. 11 is a partly sectional view showing the vacuum pump of FIG. 10.

A second embodiment of the present invention is described below with reference to FIGS. 10 and 11. In the second embodiment, a displacement type pump having a shallow thread groove is provided in the positions corresponding to the second sealing portions 16*a* and 16*b* of the first embodiment. Supposing that the pump having the thread groove disposed in an upper portion of the rotor is a main pump, a sub-pump having shallow thread grooves 50*a* and 50*b* is provided to prevent gas from flowing from the gas outlet 9 into the inner spaces 11*a* and 11*b*. The sub-pump performs its function with a small flow rate.

Figure 12:
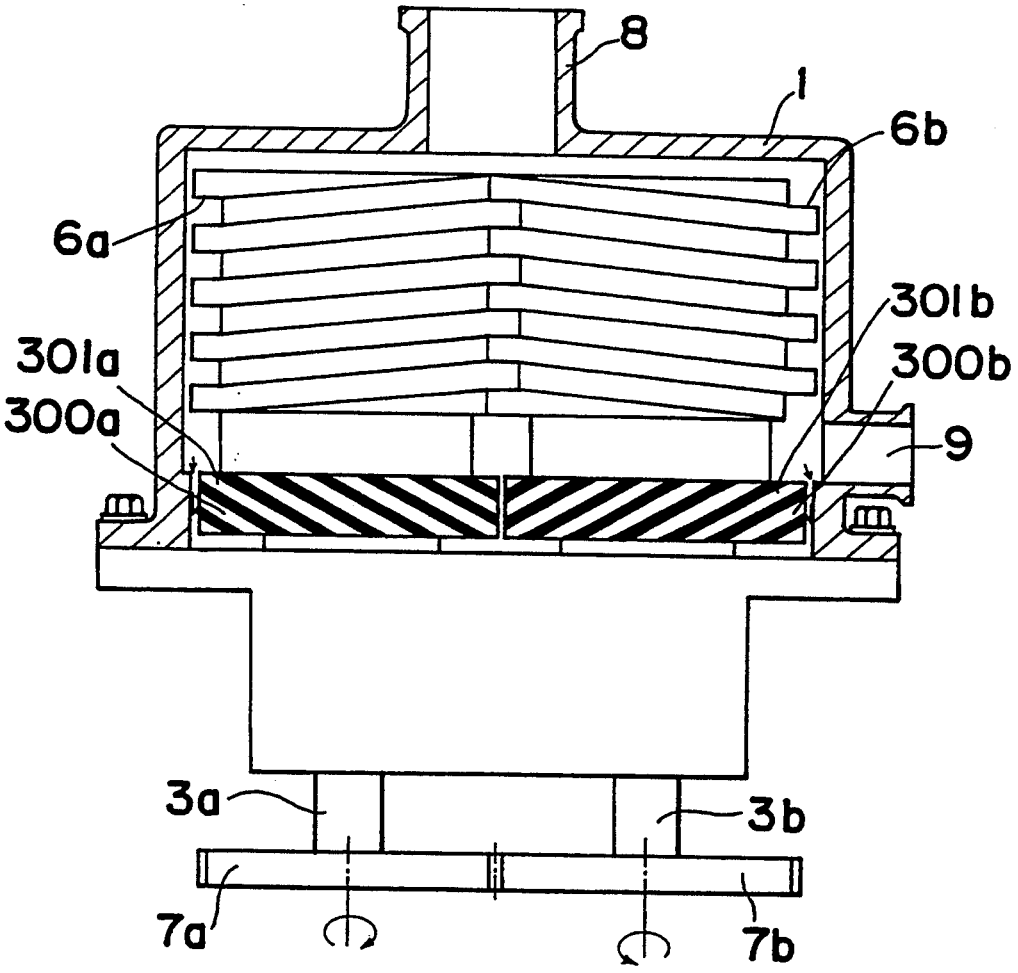
FIG. 12 is a sectional view showing a vacuum pump according to a third embodiment of the present invention.

A third embodiment of the present invention is described below with reference to FIG. 12. In the third embodiment, rather than the thread groove type pump of FIG. 10, a viscosity pump having hydro-dynamic pressure grooves 300*a* and 300*b* is provided in the positions corresponding to the second sealing portions 16*a* and 16*b* of the first embodiment and serves as the sub-pump. A gap as narrow as tens of microns is provided between rotors 301*a* and 301*b* having the hydro-dynamic pressure grooves 300*a* and 300*b* (grooves are shown by black) and a fixed wall surface of the casing 1. Gas is fed under pressure (pumping effect) by the relative motion of the rotors 301*a* and 301*b* with respect to the fixed wall as shown by arrows. Thus, gas can be prevented from flowing from the atmospheric air side into the inner space (not shown) formed in the rotors 301*a* and 301*b*.

Figure 13:
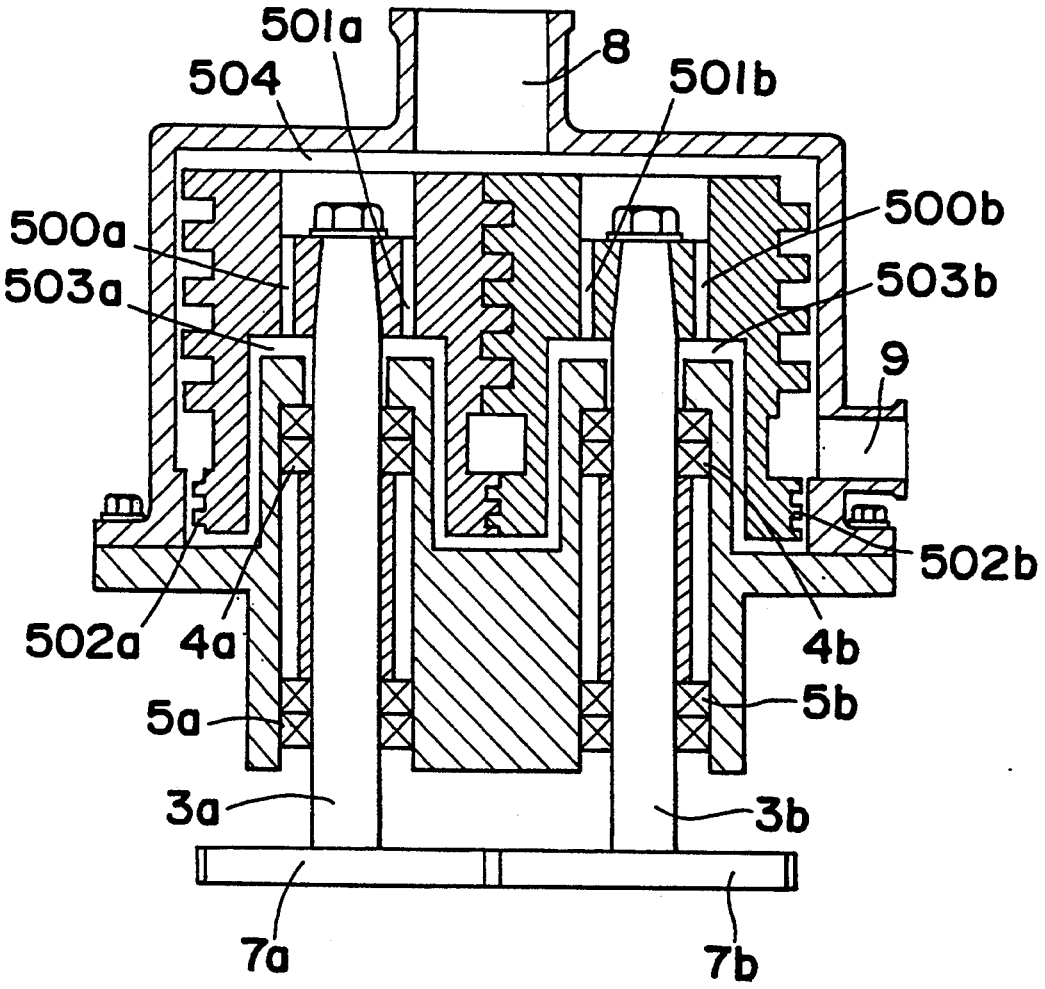
FIG. 13 is a sectional view showing a vacuum pump according to a fourth embodiment of the present invention.

A fourth embodiment of the present invention is described below with reference to FIG. 13. In the fourth embodiment, communicating paths 500*a*, 500*b*, 501*a*, 501*b* are formed in the vacuum pump provided with the sub-pump of the second embodiment, shown in FIGS. 10 and 11, so as to communicate inner spaces 503*a* and 503*b* with the gas inhaling-side surface 504. The maximum flow rate of the sub-pump having thread grooves 502*a* and 502*b* may be reduced to a great extent compared with that of the main pump. But in the vacuum pump in which the attainable vacuum pressure of the sub-pump is greater than that of the main pump, the communicating paths do not adversely affect the performance of the vacuum pump.

Figure 14:
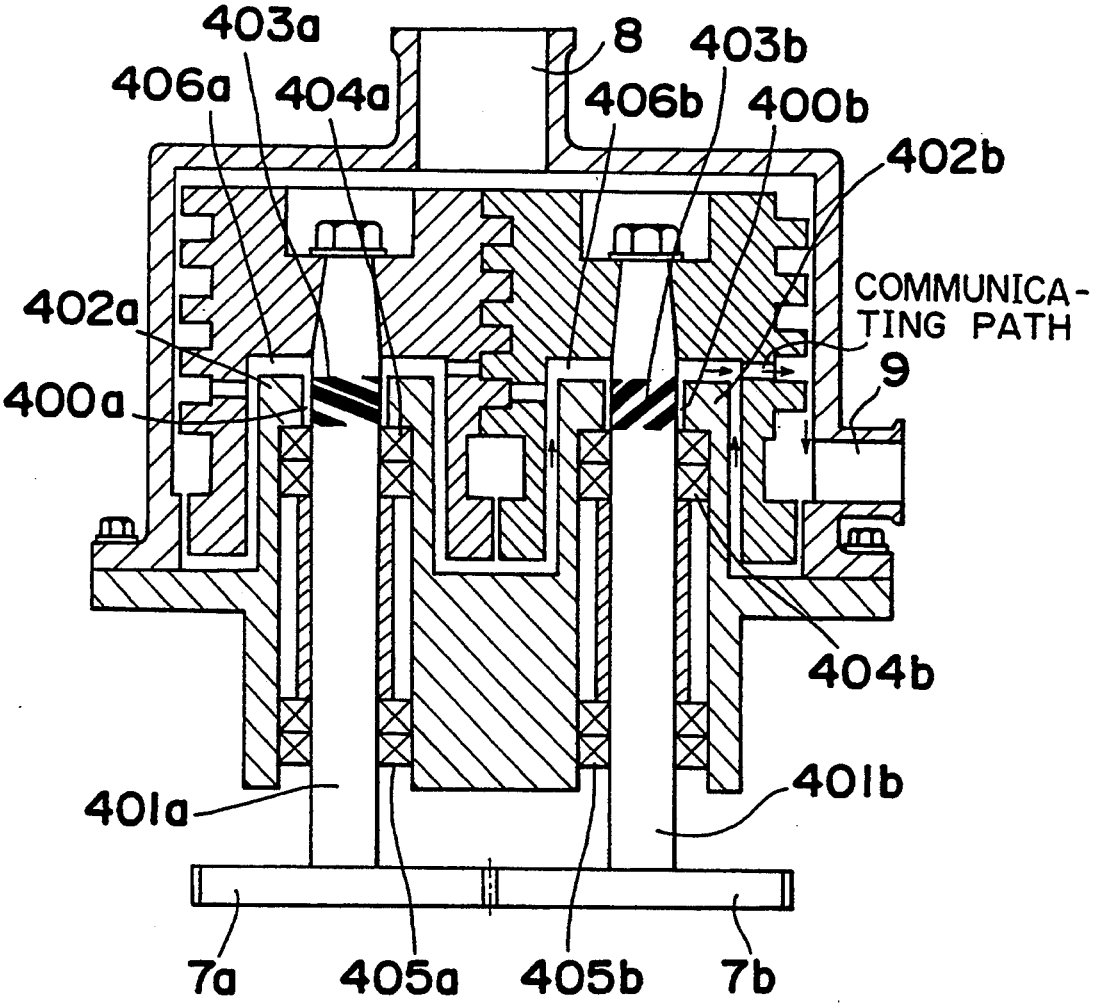
FIG. 14 is a sectional view showing a vacuum pump according to a fifth embodiment of the present invention.

A fifth embodiment of the present invention is described below with reference to FIG. 14. In the fifth embodiment, a viscosity pump having hydro-dynamic pressure grooves 403*a* and 403*b* is provided in the first sealing portions 400*a* and 400*b* formed between a shaft 401*a* and a fixed sleeve 402*a* and between a shaft 401*b* and a fixed sleeve 402*b*, respectively. The viscosity pump serves as a means for preventing the flow of the atmospheric air or a high pressure atmosphere gas purged nitrogen gas from the atmospheric air from bearing portions 404*a*, 405*a* and 404*b*, 405*b* into inner spaces 406*a* and 406*b*, respectively.

Figure 15:
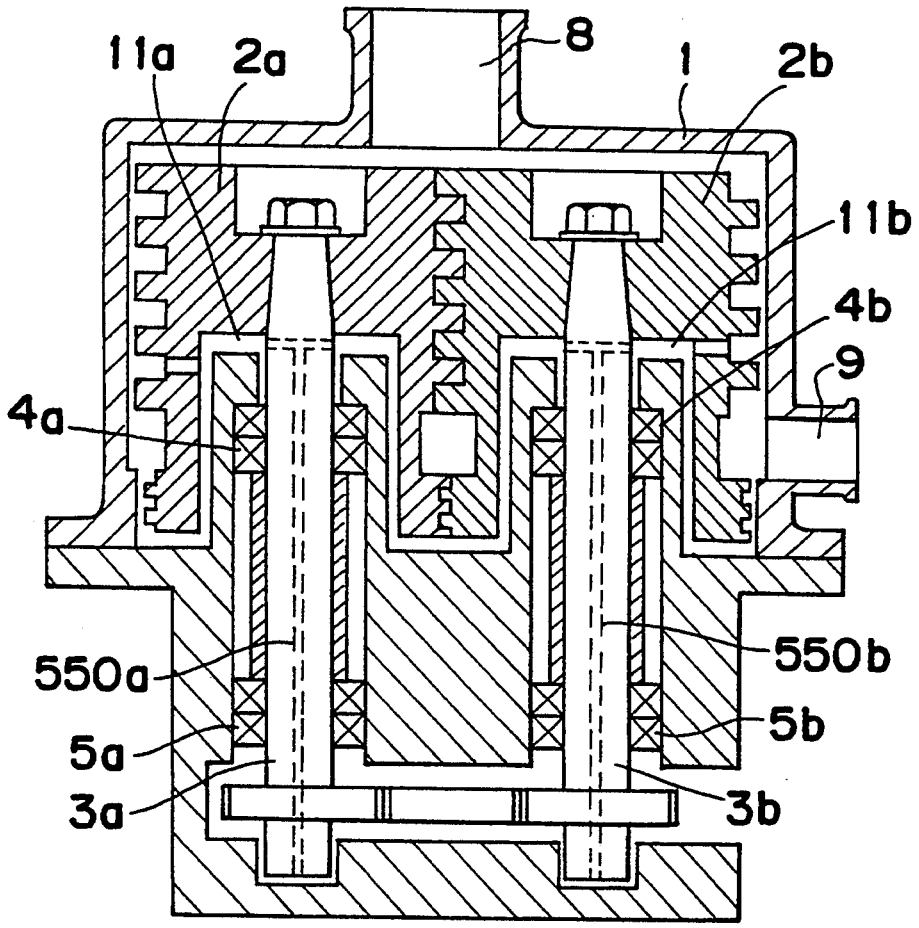
FIG. 15 is a sectional view showing a vacuum pump according to a sixth embodiment of the present invention.

A sixth embodiment of the present invention is described below with reference to FIG. 15. In the sixth embodiment, the inner spaces of the rotors 2*a* and 2*b* and the surfaces of first (lower) ends of the shafts thereof are communicated with each other by communicating paths 550*a* and 550*b* so as to reduce the pressure difference between the upper end surface and the lower end surface of each of the shafts 3*a* and 3*b* of the rotors 2*a* and 2*b*. Thus, the thrust load is reduced greatly. According to this construction, the thrust load to be generated by the pressure difference between the end surfaces of the rotors 2*a* and 2*b* can be reduced to an insignificant level.

Figure 16:
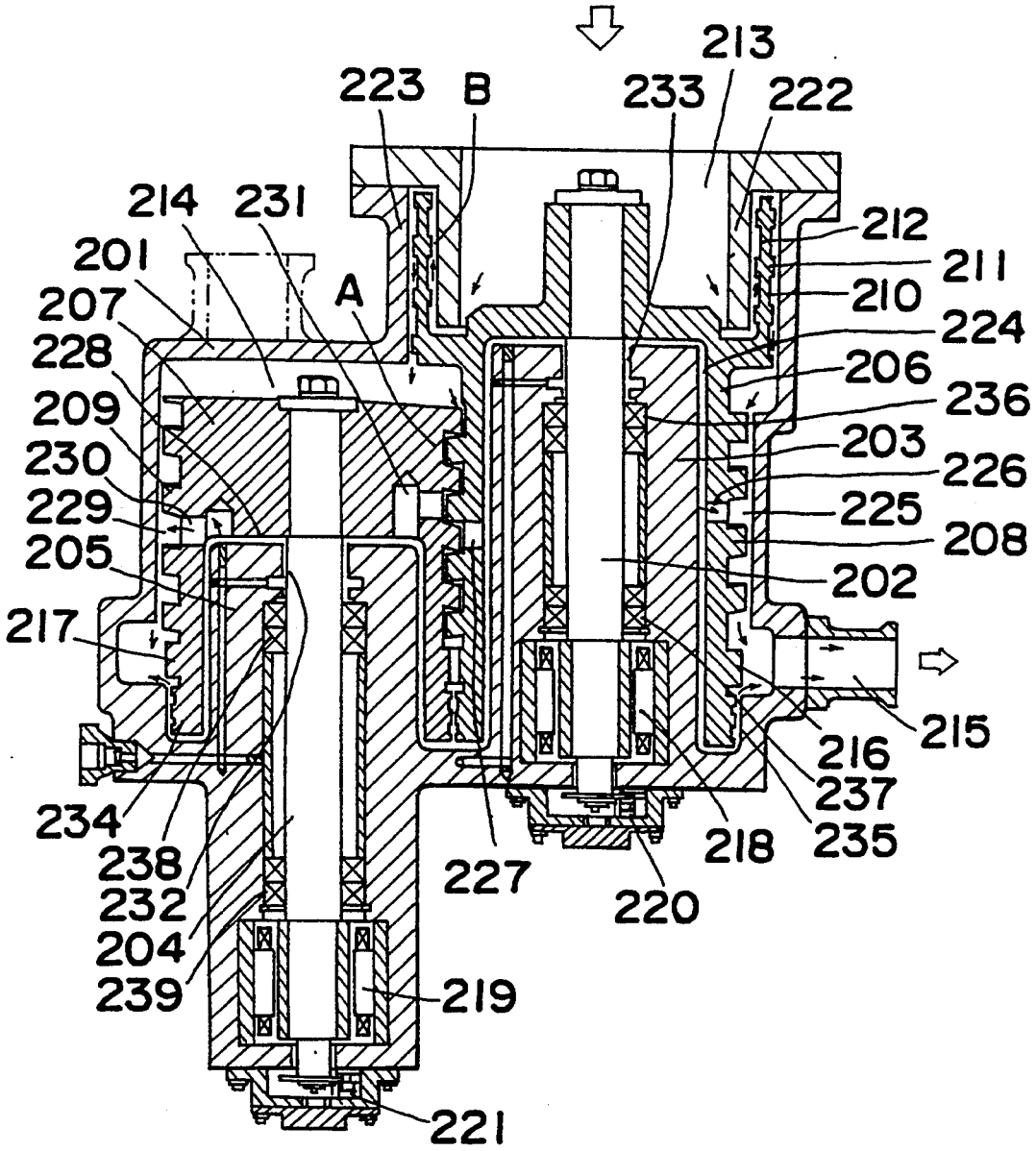
FIG. 16 is a sectional view showing a vacuum pump according to a seventh embodiment of the present invention.

A seventh embodiment of the present invention is described below with reference to FIG. 16. In the seventh embodiment, the present invention is applied to a wide-band vacuum pump in which rotors synchronously rotate without contacting each other.

The present inventors have proposed a composite vacuum pump composed of a displacement type and turbo type pump. The vacuum pump comprises a plurality of rotors driven by a corresponding motor and rotating synchronously without contacting each other, and a detecting means such as a rotary encoder for detecting the rotational angle and the number of rotations of the rotors. According to the invention of this proposal, the rotors rotate at a high speed; no maintenance is required; the vacuum pump can be cleaned and miniaturized easily; and a wide range of ranging from atmospheric pressure to a high degree of vacuum can be generated by one vacuum pump.

Figure 17:
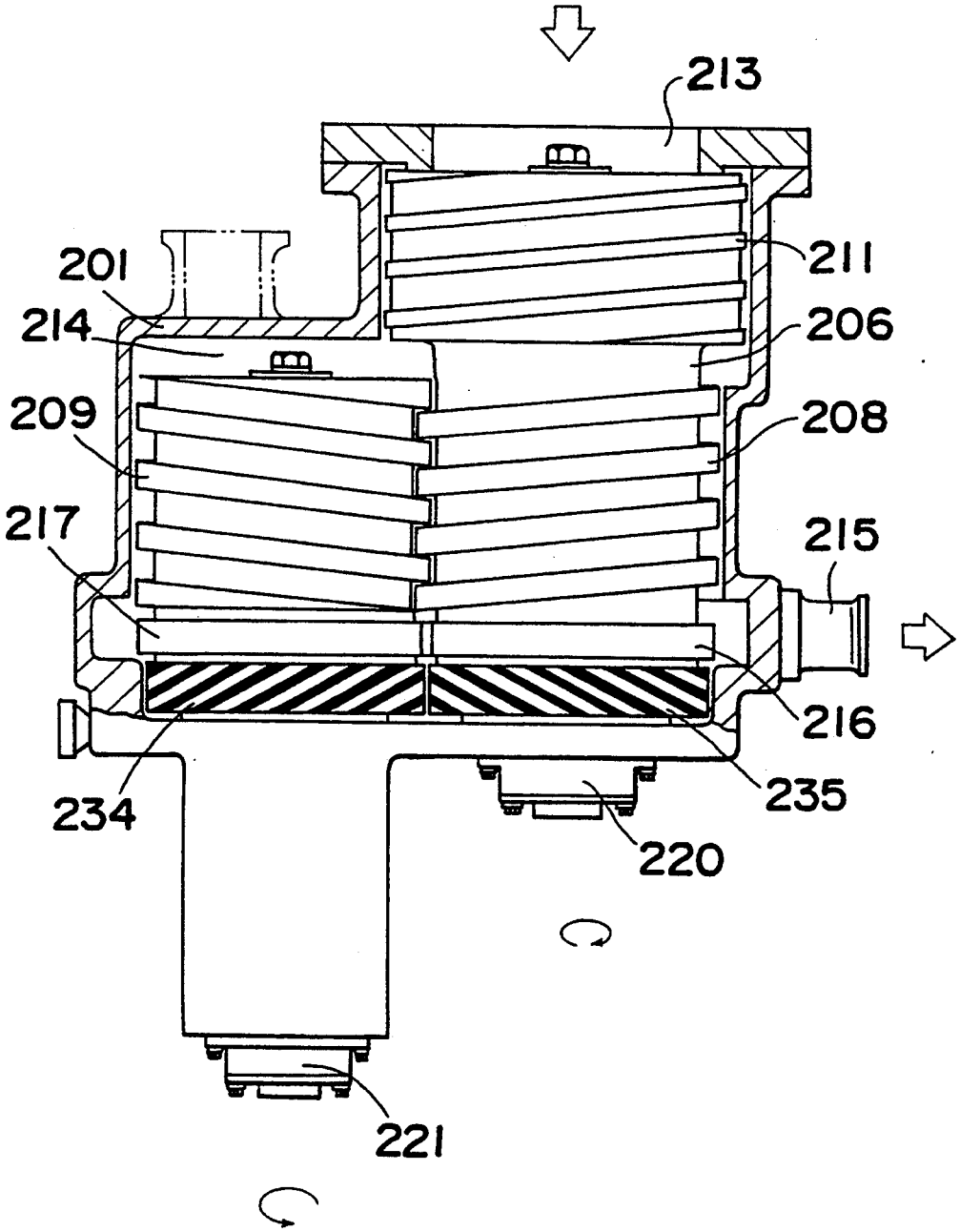
FIG. 17 is a partly sectional view showing the vacuum pump of FIG. 16.

The invention of the above-described proposal can be improved by applying the present invention thereto. The vacuum pump according to the seventh embodiment comprises a housing 201; a first fixed sleeve 203 vertically accommodating a first rotary shaft 202; and a second fixed sleeve 205 vertically accommodating a second rotary shaft 204. The rotary shafts 202 and 204 coaxial with cylindrical rotors 206 and 207, respectively, are inserted through the center thereof, respectively, and supported by ball bearings 236, 237 and 238, 239, respectively. Thread grooves 208 and 209, engaging each other and serving as fluid transporting grooves, are formed on the peripheral surfaces of the rotors 206 and 207, respectively. The portion in which the thread grooves 208 and 209 engage each other is denoted as a structural portion (A) of a displacement type vacuum pump. A cylindrical rotary sleeve 210 disposed at an upper portion of the first rotary shaft 202 is integral with the rotor 206. Fixed cylinders 222 and 223 are provided on the casing 201 so that the casing 201 accommodates the rotary sleeve 210 in one direction. Spiral grooves 211 and 212 having a drag operation are formed on the outer and inner surfaces of the rotary sleeve 210. The portion composed of the rotary sleeve 210 and the fixed cylinders 222 and 223 is denoted as a structural portion (B) of a drag pump for discharging gas at a medium to high degree of vacuum. The spiral grooves 211 and 212 discharge gas which has flowed from a first gas inhaling opening 213 to a space 214 accommodating the displacement type pump having the thread groove. The gas which has flowed into the displacement type pump having the thread groove is discharged from a gas discharge outlet 215. While the pressure in the vacuum chamber is in the vicinity of the atmospheric pressure after the pump starts operating, gas is inhaled from a second gas inhaling opening shown by two-dot chain lines. When the pressure in the vacuum chamber has reached a pressure in the vicinity of the vacuum pressure, gas is in inhaled from the first gas inhaling opening 213. Gears 216 and 217 for preventing the thread grooves from contacting each other are disposed on the peripheral surface of the lower end of each of the rotors 206 and 207. A solid lubricating film is formed on the gears 216 and 217 so that the film prevents the gears 216 and 217 from being damaged by the contact between the gears 216 and 217 to some extent. The backlash $\delta_2$ of the gears 216 and 217 is smaller than the backlash $\delta_1$ (not shown) of the screws formed on the peripheral surfaces of the rotors 206 and 207. Accordingly, when the rotary shafts 202 and 204 do not rotate synchronously, the gears 216 and 217 contact each other before the thread grooves 208 and 209 contact each other. In this manner, the gears 216 and 217 prevent the thread grooves 208 and 209 from contacting each other. The first and second rotary shafts 202 and 204 are rotated at a speed as high as tens of thousands of revolutions per minute by each of AC servo motors 218 and 219 disposed at lower portions thereof. The rotation of the first and second rotary shafts 202 and 204 synchronously is controlled as follows: Rotary encoders 220 and 221 are disposed below the first and second rotary shafts 202 and 204, respectively, as shown in FIG. 17. Pulses outputted from the rotary encoders 220 and 221 are compared with a predetermined instruction pulse (target value). The deviations between the target values and the output values indicating the number of rotations and the rotational angle of each rotary shaft 202 and 204 are calculated by a phase-difference counter. The rotation of each of the servo motors 218 and 219 is controlled to reduce the deviation. Laser type encoders having a high resolution and a high response obtained by the application of the diffraction and interference of laser beam is used in this embodiment, but a magnetic encoder or an optical encoder may be used.

The rotor 206 has communicating paths 226 and 227 communicating an inner space 224 and a fluid transporting space 225 with each other. The rotor 227 has communicating paths 230 and 231 communicating an inner space 228 and a fluid transporting space 229 with each other. Nitrogen gas is supplied to the space between the ball bearing 238 and a first sealing portion 232 and the space between the ball bearing 236 and a first sealing portion 233. The first sealing portions 232 and 233 are formed between the second fixed sleeve 205 and the second rotary shaft 204 and between the first fixed sleeve 203 and the first rotary shaft 202, respectively. Dynamic pressure sealing portions 234 and 235 (grooves are shown in black) serving as second sealing portions are disposed on the lower end surface of each of the rotors 207 and 206, respectively.

Figure 18:
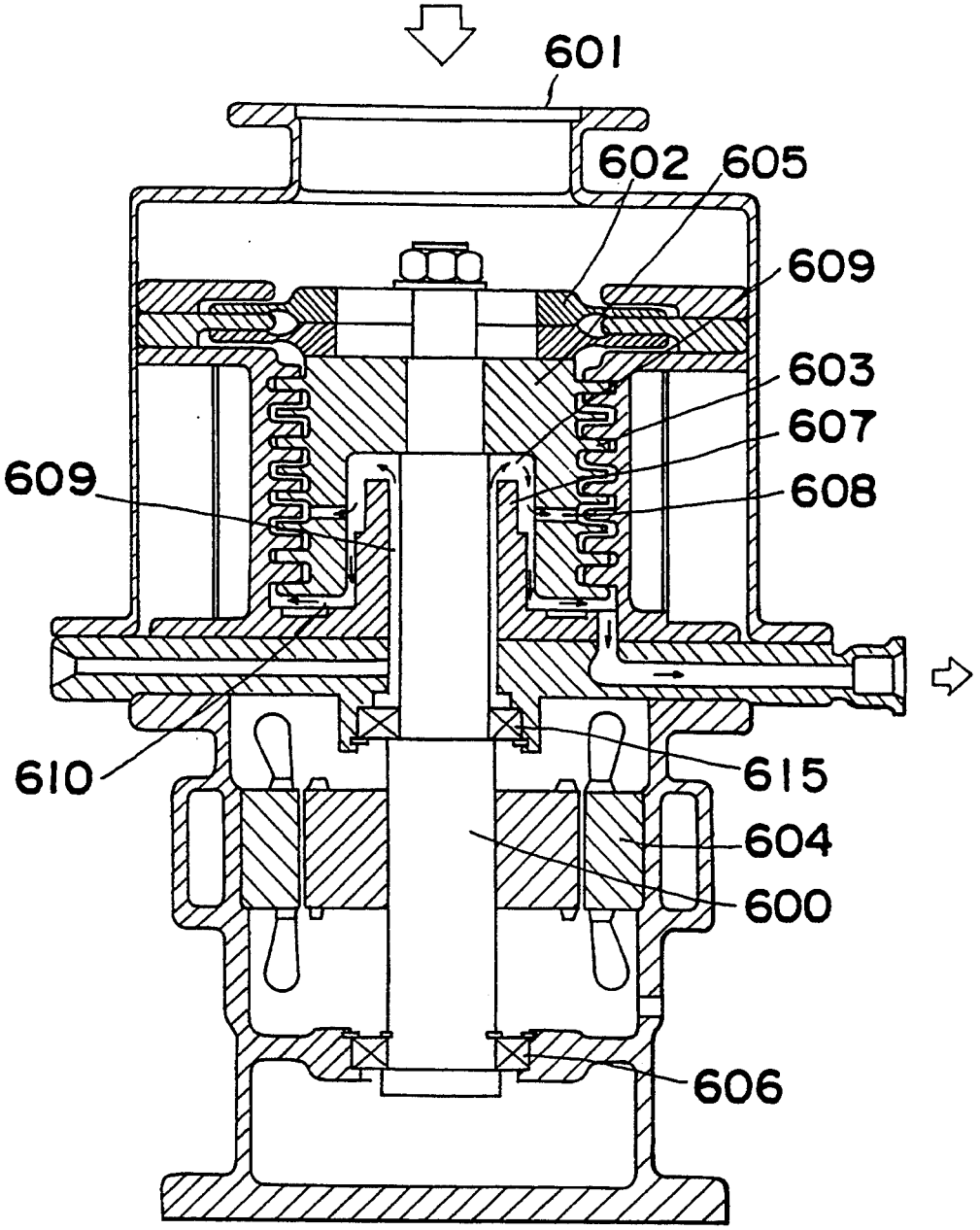
FIG. 18 is a sectional view showing a vacuum pump according to an eighth embodiment of the present invention.

An eighth embodiment of the present invention is described below with reference to FIG. 18. In the eighth embodiment, the present invention is applied to a rotor turbo type dry pump. A large-diameter centrifugal element type drag pump 602 is disposed on the gas inhaling side 601 of a rotor 605 fixed to a rotary shaft 600. A circular flow-element type pump 603 which provides a high compression ratio in a viscous flow is disposed below the pump 602. The rotary shaft 600 supported by ball bearings 615 and 606 is driven by a high frequency motor 604. The rotor 605 has a first sealing portion 609 formed in a narrow space between the rotary shaft 600 and a fixed sleeve 607. A second sealing portion 610 composed of a shallow dynamic pressure groove is formed in the shallow space between the lower end surface of the rotor 605 and the fixed sleeve 607. A communicating path 608 communicates with an inner space 609 and the pump 603. The rotor vacuum pump of the above construction reduces the difference between the pressure to be applied to the upper surface of the rotor 605 and the pressure to be applied to the lower surface thereof and the load to be applied to the ball bearings 605 and 606.

According to the above-described embodiments, the communicating path for communicating the inner space of the rotor and the fluid transporting space with each other is formed at the rotor, but the same effect can be obtained by forming the communicating path on the casing which is stationary. In addition to a pump which uses gas such as air, the fluid rotating apparatus of the embodiments may be applied to a pump or a compressor which uses oil, water, or refrigerant. For example, if each of the embodiments is applied to an air conditioning screw compressor, the pressure difference between the gas inhaling side and the gas discharge side is normally $\Delta P = 10 \sim 20$ kg/cm$^2$. Therefore, a large thrust load is applied to the rotary portion of the compressor while according to the embodiments, a small load is applied thereto. Preferably, the screw to be applied in this case is of a multiplex winding structure such as thread grooves as used in the embodiments of the present invention, and the opening of the communicating path is disposed in the intermediary portion of the screw.

According to the vacuum pump of the embodiments of the present invention, the gas-communicating path is formed at the rotor or on the casing so that the pressure is equally applied to both end surfaces of the rotor. Accordingly, the thrust load generated due to the pressure difference between the upper surface of the rotor and the lower surface thereof is decreasingly applied to the rotor. For example, supposing that the pressure difference between the gas inlet side of a twin rotor-used pump comprising a thread groove and the gas outlet side thereof is $\Delta P = 1$ kg/cm$^2$, the diameter of each rotor is 10 cm, and the diameter of the shaft of each rotor is 1.8 cm, a thrust load of 78.5 kg is applied to the bearing portion, while according to the vacuum pump of the embodiments, a thrust load of as small as 2.5 kg is applied to the bearing portion thereof excluding the thrust load applied to the shaft.

One opening of the communicating path for communicating the gas inhaling-side surface of the rotor and the gas discharge-side surface (inner space of the rotor) with each other is communicated with the inner space of the rotor and the other opening thereof is communicated with the fluid-transporting space. This construction provides the following effects:

(1) This construction does not affect the pressure on the gas inhaling side. Therefore, the fundamental function (ultimate vacuum) of the pump is not damaged.

(2) Pressure can be equally applied to the upper and lower surfaces of the rotor irrespective of the condition of the pressure on the gas inhaling side and that on the gas discharge side. Accordingly, a small thrust load is always applied to the bearing of the pump in the transient state between the start time of the pump in which the pressure on the inhaling side is atmospheric pressure and the steady operation state, namely, in the state in which a low degree of vacuum is attained on the gas inhaling side.

According to the embodiments of the present invention, the sealing portion for preventing gas from flowing in is formed on the gas discharge side of the inner space of the rotor or a portion accommodating a bearing and connected with a high pressure side, namely, a portion in which pressure has increased by the purge of nitrogen gas. As a result, the pressure in the inner space of the rotor can be promptly equalized to the pressure in the fluid-transporting space, namely, the pressure on the gas inhaling side.

The embodiments can be more effectively embodied by providing the micro-pump which prevents gas from permeating from outside into the sealing portion. The micro-pump may be of a displacement type having a shallow groove or a viscosity type having a dynamic pressure groove.

The following effects can be obtained by applying the embodiments to the vacuum pump which employs the two rotors which synchronously rotate without contacting:

(1) Since thrust load can be greatly reduced, the PV value of a bearing is reduced. Consequently, an oil-free ceramic bearing or a static pressure bearing can be used. As a result, even though the apparatus has timing gears, it is necessary to lubricate only the timing gears disposed on the side opposite to the pump. Thus, the lubrication design of the apparatus can be simplified.

(2) It is unnecessary to use timing gears which require lubrication.

Owing to the above effects (1) and (2), an oil-free vacuum pump required in recent years in semiconductor-manufacturing processes which uses reaction gas can be provided. In addition, since the rotors rotate without contacting each other, the pump can be operated at a high speed and provides the atmospheric pressure and a high degree of vacuum.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid rotating apparatus comprising:

a casing having a gas inhaling inlet and a gas discharge outlet;

a pair of rotors rotatably mounted in said casing and having a pair of interengaging male and female fluid-transporting grooves, respectively;

a driving means for driving said rotors to rotate synchronously;

at least one bearing portion for supporting said rotors; and a sealing portion, formed between one of said rotors and said casing, for preventing fluid from flowing into an inner space at a gas discharge side of said one of said rotors, said sealing portion comprising a pump.

2. A fluid rotating apparatus as recited in claim 1, wherein each of said rotors comprises a rotor portion and a shaft portion; and said inner space is defined by an end surface of said rotor portion of said one of said rotors opposite a gas inhaling-side thereof.

3. A fluid rotating apparatus as recited in claim 1, wherein each of said rotors comprises a rotor portion and a shaft portion; and said rotor portion of said one of said rotors has a first end portion adjacent said gas inhaling inlet of said casing, and a second end portion opposite said first end portion, said second end portion of said rotor portion of said one of said rotors having said inner space defined therewithin.

4. A fluid rotating apparatus as recited in claim 1, wherein each of said rotors comprises a rotor portion and a shaft portion; and said rotor portion of said one of said rotors has a first end portion adjacent said gas inhaling inlet of said casing, and a second end portion opposite said first end portion, said sealing portion being formed between said casing and said second end portion of said rotor portion of said one of said rotors.

5. A fluid rotating apparatus as recited in claim 1, wherein each of said rotors comprises a rotor portion and a shaft portion; and said sealing portion is formed between said casing and said shaft portion of said one of said rotors.

6. A fluid rotating apparatus as recited in claim 1, further comprising a second sealing portion, formed between a second one of said rotors and said casing, for preventing fluid from flowing into a second inner space at a gas-discharge side of said second one of said rotors, said second sealing portion comprising a pump.

7. A fluid rotating apparatus as recited in claim 1, wherein said pump comprises thread grooves formed in said one of said rotors.

8. A fluid rotating apparatus as recited in claim 1, wherein said pump comprises hydro-dynamic pressure grooves formed in said one of said rotors.

9. A fluid rotating apparatus as recited in claim 1, wherein each of said rotors comprises a rotor portion and a shaft portion;

said rotor portion of said one of said rotors has a first end portion adjacent said gas inhaling inlet of said casing, and a second end portion opposite said first end portion, said second end portion of said rotor portion of said one of said rotors having said inner space defined therewithin; and said sealing portion is formed between said casing and said second end portion of said rotor portion of said one of said rotors.

10. A fluid rotating apparatus as recited in claim 1, wherein each of said rotors comprises a rotor portion and a shaft portion;

said rotor portion of said one of said rotors having a first end portion adjacent said gas inhaling inlet of said casing, and a second end portion opposite said first end portion, said second end portion of said rotor portion of said one of said rotors having said inner space defined therewithin; and said sealing portion is formed between said casing and said shaft portion of said one of said rotors.

* * * * *